United States Patent [19]

Quinn

[11] 4,221,535

[45] Sep. 9, 1980

[54] LATCH FOR LIFT TRUCK FORK

[75] Inventor: Russell C. Quinn, Twinsburg, Ohio

[73] Assignee: Jos. Dyson and Sons, Inc., Eastlake, Ohio

[21] Appl. No.: 961,551

[22] Filed: Nov. 17, 1978

[51] Int. Cl.[2] ..... B66F 9/14

[52] U.S. Cl. ..... 414/785; 414/667; 414/671

[58] Field of Search ..... 414/785, 659, 664, 667, 414/671; 292/254; 403/107, 108, 326, 329, 325

[56] References Cited

U.S. PATENT DOCUMENTS

| | | | |
|---|---|---|---|
| 1,824,023 | 9/1931 | Langsner | 403/107 |
| 2,507,279 | 5/1950 | Smulski | 403/107 |
| 3,356,241 | 12/1967 | Varilek | 414/785 |
| 4,113,128 | 9/1978 | Foss | 414/785 |

*Primary Examiner*—Lawrence J. Oresky
*Attorney, Agent, or Firm*—Frank B. Robb

[57] ABSTRACT

There is disclosed latching instrumentalities or structure for the forks of fork lift trucks which involves forming the head of a fork with a recess, a strap member of resilient construction having a detent formed thereon to engage a notch on a fork lift truck support being mounted on the head and in conjunction with the recess, the member being operable by simple bending of a portion thereof to move the detent out of a notch and permit the fork to be moved transversely along the truck.

5 Claims, 3 Drawing Figures

LATCH FOR LIFT TRUCK FORK

SUMMARY OF THE INVENTION

This invention involves latching structure for fork lift forks, which includes a specially formed recess in the head of such fork, by which recess the fork is supported on a rail carried by a fork lift truck, and the truck including notches on this rail, the latch structure comprising a strap member of suitable form to be removably mounted on the head with a detent formed thereon and positioned within the recess to engage a notch of a lift truck rail, the strap member having a handle to manipulate the detent out of notch engaging position, the strap member being sufficient resilient whereby to tend to move the detent into notch engaging position and effect engagement when suitably aligned with a notch.

BACKGROUND OF THE INVENTION

Background of the invention involves well known latch constructions for forks, and is directed to improvement in the structure of latches desirably provided for fork lift truck forks and includes a fork as before described, with the latch of special construction, to replace or in substitution for the latches known in the art, which themselves may be generally described as of the bolt latch type, wherein a bolt member is movable upwardly and downwardly and usually spring pressed to be maintained in notch engaging position to position and retain the fork of the truck in transversely located relationship.

Sometimes these bolts are provided with cam arrangements to raise and lower the same and other types of latches may be involved all usually being spring controlled so that they will engage with notches as the fork is positioned with relation thereto.

The instant invention is directed to an improved form of latch structure wherein the head of the fork is specially formed with a recess the recess providing for mounting of the fork on the truck and of such a form as to accept the novel latch member which is of resilient material and includes a detent form thereon, the detent being controllable exteriorly of the fork head even though the detent is beneath and enclosed in the recess by which the fork is supported on the truck.

With the foregoing in mind then a description of the invention is had with reference to the figures wherein.

DESCRIPTION OF THE INVENTION

Figure 1:
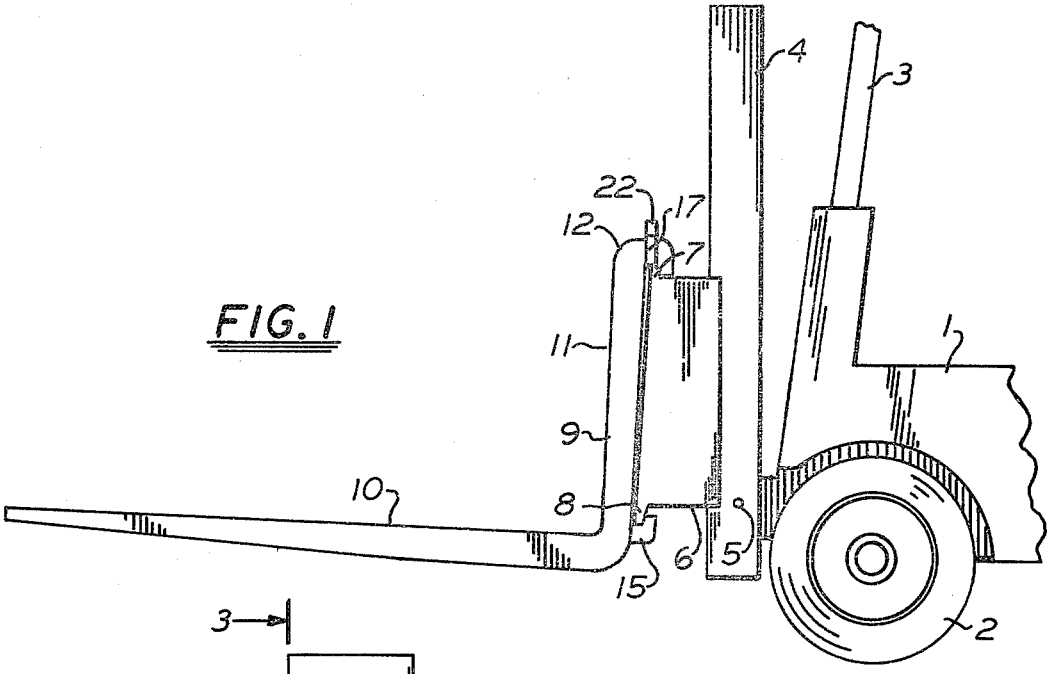
FIG. 1 is a fragmentary side elevational view of a fork lift showing a typical fork lift truck and fork arrangement to locate the environment in which the invention is found.

Referring to FIG. 1, a lift truck is generally denoted at 1 with certain supporting wheels 2 provided therefore others being usually arranged to support the other end of the truck and the truck in turn being provided with a mast 3 and an adjustable mast 4 pivotally connected at 5 to the truck, this mast carrying a carriage 6 which is vertically movable on the mast 4 in any preferred manner not shown in detail but well within the skill of the art.

This carriage 6 is provided at its upper edge with a rail 7, and at its lower portion with a further rail 8, to position a fork generally denoted 9 including the tine area 10 thereof with an upright supporting arm 11 terminating at its upper end in a head denoted 12.

Figure 2:
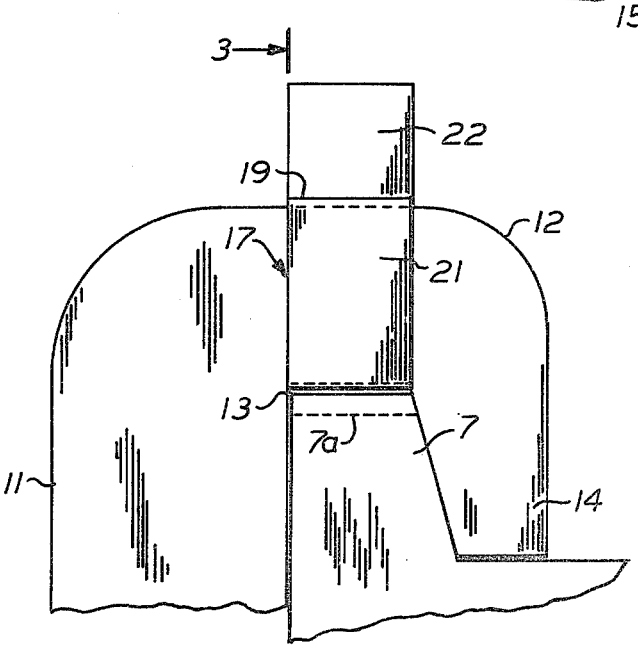
FIG. 2 is a fragmentary enlarged view showing in greater detail from a side view the arrangement of the fork and latch structure with regard to the lift truck and its supporting means.

The head 12 is as shown in detail in FIG. 2 of a formation which involves a recess 13 therein formed by a downwardly extending end 14 of hook-like configuration and also involving the upright or support arm 11 previously mentioned, generally conventional as will be understood.

The rail 7 previously referred to, is formed so as to support the fork thereon by means of the head 12 shown, the lower end of the arm 11 being equipped with a hook-like member 15, which engages the lower rail 8 and thus assists in positioning the fork with regard to the carriage 6 all generally conventional.

Figure 3:
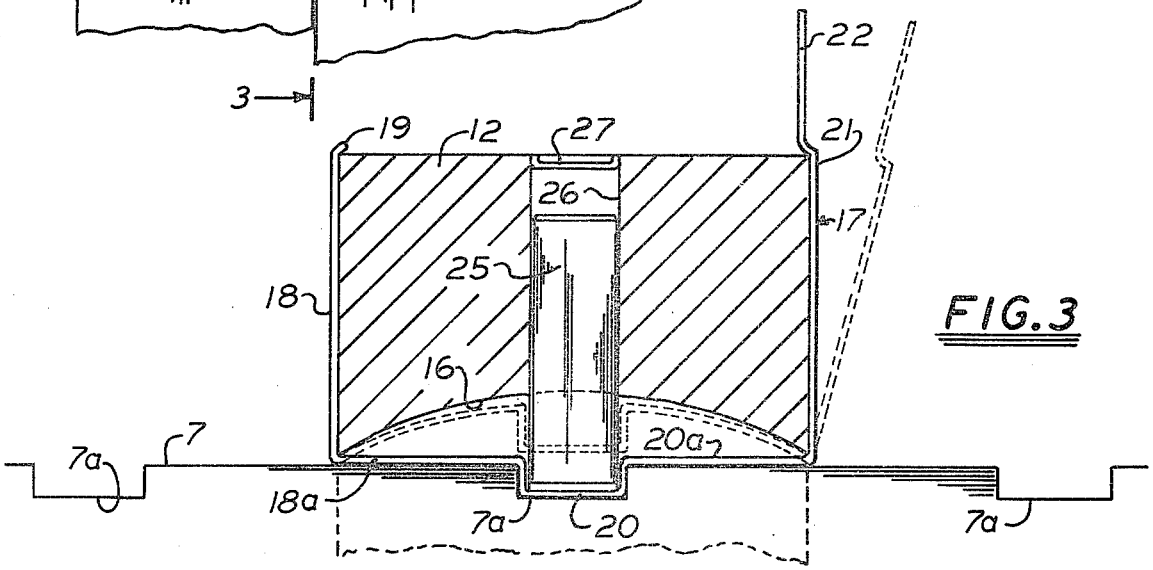
FIG. 3 is a fragmentary view of sectional form taken about on the line 3—3 of FIG. 1 looking in the direction of the arrows.

Referring now to the structure specifically relating to this invention, the fork head 12 as indicated is provided with a recess, and in this instance the recess is formed as shown in FIG. 3, so as to have an arcuate surface 16 extending from side to side.

The latch means hereof is provided in the form of a strap member generally denoted 17 U-shaped in elevation which includes a vertically upwardly extending portion or arm 18 terminating at its upper end in a retaining element 19, the lower end of the member 18 being connected to a transverse or detent portion **18*a* of the strap member, a detent 20 formed therein about midway between the sides of the head 12**.

Integral with the detent portion **18*a* the member 17 at the side opposite the portion 18 includes an upright handle part or arm 21 having a handle 22 at its upper end to manipulate the detent 20** as now to be set forth.

As will be understood from a consideration of FIG. 3, this strap member 17, is formed of resilient material and by manipulating the handle 22, into the dotted line position for example, the detent 20 and associated portion **20*a* will be caused to assume the dotted line position shown, thus raising the detent upwardly so as to be out of notch engaging position with respect to the rail 7, the notches therein being denoted 7*a***.

When the manipulation of the handle 22 is effected causing the portion **18*a* and detent 20 to assume the dotted line positions, the fork may be moved transversely. The detent 20 may subsequently engage with another notch 7*a* by releasing the handle 22** so that the resilient effects involved in this strap member are operative.

It will be understood that movement of the fork from side to side on the rail can only be effected by manipulation of the handle 22 as heretofore outlined in detail.

Under some circumstances it may be desirable to provide greater strength in the detent 20 and to that end a suitable member 25 may be availed of located in a bore 26 formed in the head 12 and extending vertically therein so as to receive and permit the reciprocation of this member 25.

The member 25 will of course fit at its lower end into the detent formation and thus be movable with the detent as the handle 22 is manipulated.

It will be apparent that this will add substantial resistive strength to the entire structure so that even if some wear takes place the entire pressure of sideward or transverse movement of the fork will not be entirely dependent upon the strength of the strap member 17 in the latch herein described but will in turn be reinforced as to its strength by this member 25 just now described.

A suitable closure cap such as 27 may be availed of to close the upper end of this bore 26 to prevent foreign matter from entering the same and possibly interfering with the operation of the part 25.

In view of the foregoing it will be apparent that a simple latch structure is provided wherein the strap-like member may be replaced even with minimum amount of difficulty if it should for some reason become broken or otherwise deformed so as to be unusable and simply by having a replacement part there will be no necessity to protect the member as it is a simple enough structure to be effective and yet inexpensive as compared with other known devices.

I claim:

1. A fork for fork lift truck, comprising a fork body, said body including a vertical arm member and a head at the upper end of the arm member, said head having a downwardly open transverse recess extending across the same, said recess being formed to receive a support rail carried by a fork lift truck and upon which the fork body may be shifted transversely, such rail having spaced notches therein, and latch means carried by the head aforesaid to maintain the body in position on the support rail, said latch means comprising a strap member carried by the head and extending along the recess, said member having a detent portion formed with a detent to engage a notch of the support rail, and means exterior of the recess forming a part of the strap member, to manipulate the detent out of notch engaging position to permit movement of the fork along such rail.

2. A fork construction as claimed in claim 1, wherein the strap member at least partially surrounds the portion of the head aligned with the recess, includes a retaining element at one end, and a handle part at the other, movement of the handle part away from the head effecting disengagement of the detent from a notch.

3. A fork construction as claimed in claim 2, wherein the recess in the head is formed to receive the detent portion of the strap member therein when the handle part is moved as stated, said member being formed of resilient material whereby the detent is caused to assume its detent acting position upon release of the handle part.

4. Fork construction as claimed in claim 2, wherein the recess is of arcuate form, the detent portion is normally generally parallel to the support surface of the support rail, the handle includes a retaining section which in cooperation with the retaining element retains the latch member in position on the head, manipulation of the handle when the fork body is removed from the support rail facilitating removal and replacement of the member on the head.

5. Fork construction as claimed in claim 2, wherein a detent pin is positioned in the head, said pin engages the detent at its lower end, and the upper portion of the pin is adapted to reciprocate in the head, and resist transverse forces along the recess directed to the detent.

* * * * *